United States Patent [19]

Kroeber et al.

[11] Patent Number: 4,589,245

[45] Date of Patent: May 20, 1986

[54] FINGER ASSEMBLY FOR CASE LOADER

[75] Inventors: Kenneth E. Kroeber, East Haddam; H. Steven Kayser, Middletown, both of Conn.

[73] Assignee: Standard-Knapp, Inc., Portland, Conn.

[21] Appl. No.: 642,335

[22] Filed: Aug. 17, 1984

Related U.S. Application Data

[63] Continuation-in-part of Ser. No. 558,497, Dec. 6, 1983, abandoned.

[51] Int. Cl.[4] ..... B65B 39/02

[52] U.S. Cl. ..... 53/248; 53/262

[58] Field of Search ..... 53/246, 247, 248, 257, 53/261, 262; 308/2 A, 2 R; 248/181, 182, 288.3; 403/122, 124, 125, 126, 143, 56

[56] References Cited

U.S. PATENT DOCUMENTS

| | | | |
|---|---|---|---|
| 167,845 | 9/1875 | Little | 403/125 |
| 4,075,819 | 2/1978 | Raudat et al. | 53/262 |
| 4,171,603 | 10/1979 | Wiseman | 53/261 |
| 4,207,721 | 6/1980 | Raudat et al. | 53/262 |
| 4,207,722 | 6/1980 | Raudat | 53/248 |
| 4,448,009 | 5/1984 | Raudat | 53/261 |

*Primary Examiner*—James F. Coan

*Attorney, Agent, or Firm*—McCormick, Paulding & Huber

[57] ABSTRACT

A finger assembly supports up to four molded fingers in circumaxially spaced relationship so that each finger can guide a bottle dropped downwardly through a pocket defined by four such finger assemblies in a packing case loader. Each finger has a spoon shaped lower end designed to preclude destructive reverse bending of the molded finger as a result of interference with a case or other impediment. The fingers are preferably biased by individual return springs and may move laterally at least slightly to accommodate misalignment between them and the case. These springs may comprise individual coil compression springs or be defined in the form of petals or leaves integrally formed in a plastic part with a central opening such that this part can be mounted to the lower face of the retaining member and be held in place by the same retaining member fastener as used to assemble the holder and retainer.

20 Claims, 27 Drawing Figures

FINGER ASSEMBLY FOR CASE LOADER

CROSS REFERENCE TO RELATED APPLICATIONS

This application is a continuation-in-part of a copending application Ser. No. 558,497 filed Dec. 6, 1983 now abandoned by the same applicants and carrying the same title. This application is also related to a pending application of the same title filed June 12, 1981 and identified by Ser. No. 273,012 since issued under U.S. Pat. No. 4,448,009, and assigned to the assignee herein.

BACKGROUND OF THE INVENTION

This invention relates generally to case loading machines of the type which include a grid assembly for handling groups of articles to be loaded into upwardly open packing cases fed to a loading station below the grid. The invention deals more particularly with an improved article guiding funnel or finger assembly arrangement for such a grid, and to an improved plastic finger for use in such a finger assembly.

In a typical case loading machine of this type, slugs of articles of uniform size and shape are grouped, and the groups or slugs are drop packed into upwardly open packing cases or cartons. Each slug of articles is accumulated in a grid assembly, which includes means for discharging the entire slug of articles for gravity fall downwardly into the upwardly open case. Finger assemblies or clusters are generally mounted to parallel rails in the grid assembly, either at the sides of individual passages for these articles, or at the corners of generally square passageways for such articles. These finger assemblies are supported below the shifting grid frame, which frame serves to control the pace of the charge or slug as it drops from the frame into the case. See for example prior art U.S. Pat. No. 4,207,722. That patent discloses a finger assembly so designed that a single screw or fastener is provided to hold four fingers at the corners of each of four adjacent article passageways in the grid assembly. This patent also shows a convenient means for permiting these fingers to be readily removed for replacement or repair.

In the above-identified copending U.S. Pat. No. 4,448,009 there is disclosed a unique upper pivoted end for each finger wherein a concave downwardly facing contour at the upper inturned end of the finger slidably engages a convex portion of a retaining member to pendulously support each finger for movement inwardly toward and outwardly away from a single centrally located fastener. The means for so biasing the fingers so that they cooperate with the fingers of other adjacent finger assemblies in each passageway comprises a single compression spring provided on the fastener and acting on a retainer to urge the retainer upwardly against a holder which supports the finger assembly from one of the parallel rails in the grid assembly itself.

The present invention seeks to carry forward the advantages of the disclosure in said patent, and to provide an improved finger assembly so designed that each of the four fingers in the finger assembly can be individually biased toward normal positions for guiding the free falling articles, and wherein an improved plastic finger is adapted to be itself resiliently deformable in one direction only, that is which finger is so configured that when it engages a part of the case or case contents during mating of the fingers with the upwardly open packing case during the machine cycle, such finger will deform in a direction which does not cause damage to the article being handled or to the components of the machine itself. These advantages are achieved in a finger assembly which is also capable of providing for limited lateral movement of the fingers to accommodate misalignment between the grid assembly and the case partitions such as might be expected to lead to interference between the depending fingers and a cell or partition within the packing case to be loaded.

SUMMARY OF THE INVENTION

In accordance with the present invention an improved finger assembly for a case loader is provided, and each finger assembly includes a holder of the type adapted to support up to four fingers in four adjacent corners of four associated pockets or passageways in a typical grid assembly. Each finger holder is mounted in depending position on one of several rails and each finger has an upper inturned end portion such that the finger can be pivotally supported between the holder and a retaining member in a socket defined cooperatively by the holder and retainer. Each finger is capable of limited pivotable movement toward and away from a normal centered position associated with an associated pocket, and each finger is also capable of limited lateral movement in a direction perpendicular to the plane of such pivotal motion. A single fastener is preferably provided in a central opening defined by the retainer. A coiled compression spring is optionally provided on the fastener to urge the retaining member upwardly against the holder, and thereby exert some restoring force on all of the fingers collectively. Preferably, however, individual finger springs are provided for returning each finger to its associated normal position. These finger return springs are provided between each finger and the retainer and may comprise individual coil springs or individual petals of a resiliently deformable plastic part provided on the fastener. Finally, in a preferred embodiment, each finger has an upper inturned end portion which is adapted to be received on a generally spherical bearing surface cooperatively defined by the holder and retainer, the finger and retainer are also complementarily shaped so as to accommodate the generally spherically shaped finger upper end therebetween. The lower end of each finger has a generally spoon shape so that the front surface, which is engaged by an article dropped downwardly into a case, is concave in configuration both in vertical cross section and in horizontal cross section. This spoon shaped end portion for the fingers assures that the fingers will deform readily in a direction toward the centerline of each pocket passageway, but will not readily deform in the opposite direction. Thus, interference between a finger and a partition in the case or between a finger and a foreign object left inadvertly in a case to be loaded will deflect the finger in only one direction, a fact which leads to longer life for these fingers than has heretofore been possible.

DETAILED DESCRIPTION OF FIGS. 1-15 INCLUSIVELY

Figure 1:
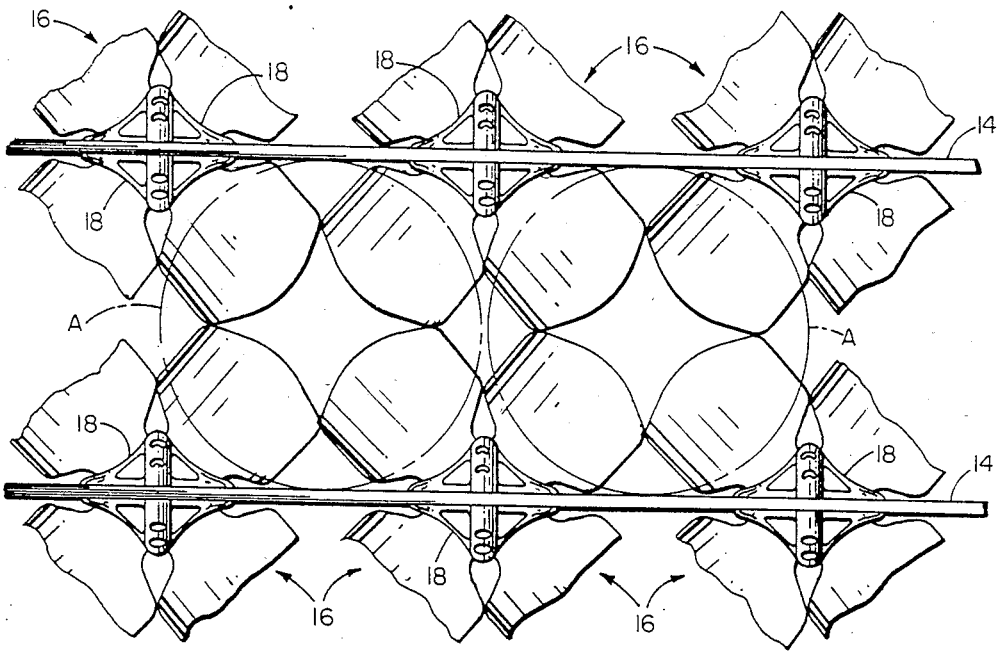
FIG. 1 is a fragmentary plan view of a portion of a case loader having finger assemblies embodying the present invention provided on the parallel rails which are part of the case loader grid assembly.

Turning now to FIGS. 1-15 of the drawings in greater detail, and referring particularly to FIG. 1, a portion of a case loading machine is shown as comprising a grid assembly which includes parallel mounting rails 14, 14 supported below a shifting grid frame (not shown) such that a slug of articles A, A can be formed in aligned rows so that the entire slug can be selectively dropped downwardly through pockets defined by finger assemblies 16, 16 secured to the rails 14, 14 at spaced locations. As so arranged these finger assemblies define a plurality of pockets or passageways, each of which passageways is suitable for guiding an article A as it is dripped by gravity into a case provided therebelow. A typical slug or charge of articles might comprise any number of rows and columns, and FIG. 1 illustrates only two articles A, A but it will be apparent that any number might be handled in a typical case packer. The above mentioned Pat. No. 4,448,009 and issued Pat. No. 3,561,189 are incorporated by reference herein to supplement this disclosure.

The rails 14, 14 are supported in the grid assembly so as to be adjustable toward and away from one another, and the finger assemblies indicated generally at 16, 16 are adjustably mounted in spaced relationship to one another. This configuration permits the grid assembly to accommodate articles of various size in a case loader equipped with a grid assembly having fingers of the present invention.

Figure 2:
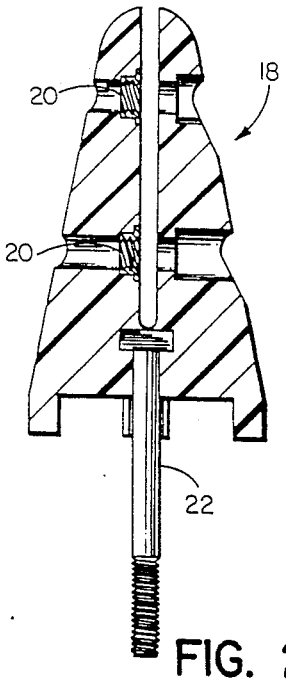
FIG. 2 is a sectional view taken on the line 2—2 of FIG. 4.
Figure 3:
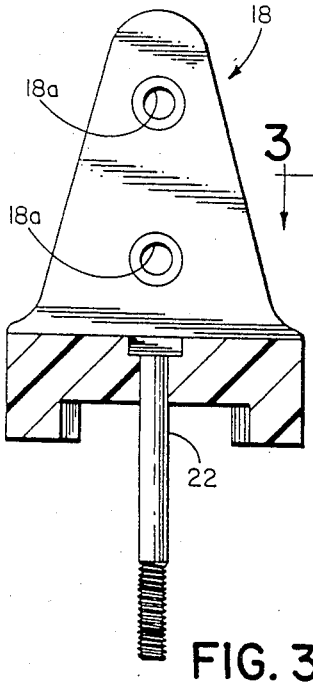
FIG. 3 is a sectional view taken on the line 3—3 of FIG. 4.
Figure 4:
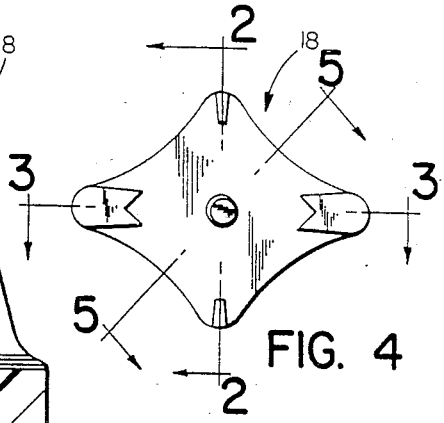
FIG. 4 is a bottom view of one holder in a finger assembly of the type illustrated in FIG. 1 with the retainer and fingers being omitted from FIGS. 2, 3 and 4 for clarity.

These fingers are clustered in finger assemblies, and each assembly includes a holder, such as depicted FIGS. 2, 3 and 4, which holders are secured to a rail 14 by fasteners (not shown). Each holder has openings 18*a*, 18*a* provided for this purpose and a slot for receiving the rail. The rails 14, 14 are provided with spaced openings to receive these fasteners, and a threaded insert 20 is provided in each holder opening 18*a* to threadably receive such a fastner and secure the holder 18 in place on the rail 14. The holder is preferably fabricated from a molded plastic material and the head portion of fastener 22 is molded into the base of the holder 18 to releasably clamp a finger retaining member, to be described, to the holder 18 so that a plurality of fingers, to be described, are pivotably supported for movement toward and away from a central vertical axis defined by the holder and fastener in much the same manner as shown and described in the prior patent application Ser. No. 273,012 referred to previously.

Figure 5:
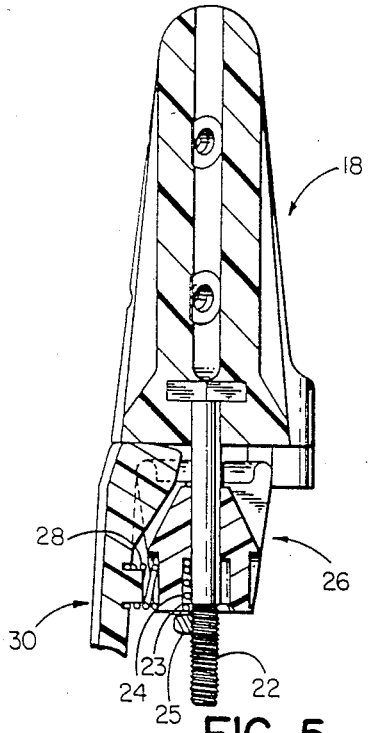
FIG. 5 is a sectional view taken generally on the line 5—5 of FIG. 4 but illustrating the upper end of one finger in position between the holder and the retainer, and with a fastener securing the holder and retainer in position.
Figure 6:
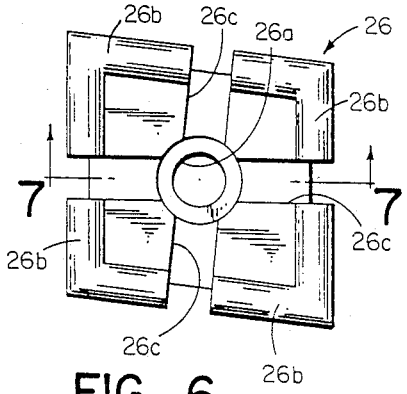
FIG. 6 is a top plan view of the retaining member illustrated in FIG. 5.
Figure 7:
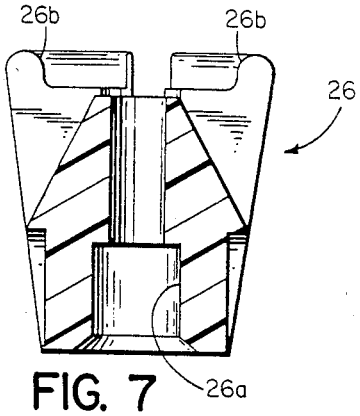
FIG. 7 is a sectional view taken generally on the line 7—7 of FIG. 6.
Figure 9:
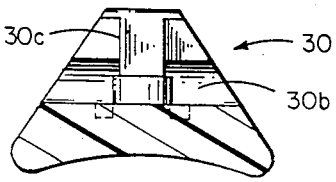
FIG. 9 is a sectional view of the finger illustrated in FIG. 8, being taken on the line 9—9 of FIG. 12.
Figure 8:
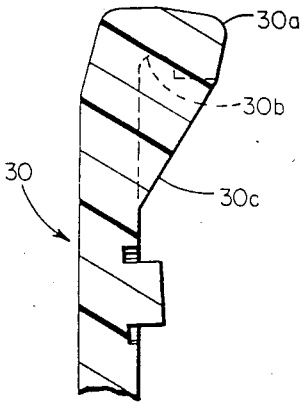
FIG. 8 is an enlarged view of the upper end portion of the finger shown in FIG. 5.

The finger retaining member which is designed for use with the holder of FIGS. 2, 3 and 4 is depicted in FIGS. 6 and 7, and is shown in assembled relationship with the holder in FIG. 5 where one finger 30 is pivotably supported in a socket defined between the holder 18 and the finger retaining member 26. Spring 24, acting between retainer 26 and washer 23 backed up by nut 25 serves to bias and to locate the finger as described in said application Ser. No. 273,012. Biasing means 28, associated with each finger urges each finger away from the vertical central axis of the holder and fastener, toward a normal position wherein the finger extends outwardly into a pocket or passageway defined by several such finger assemblies as shown in FIG. 1.

Figure 12:
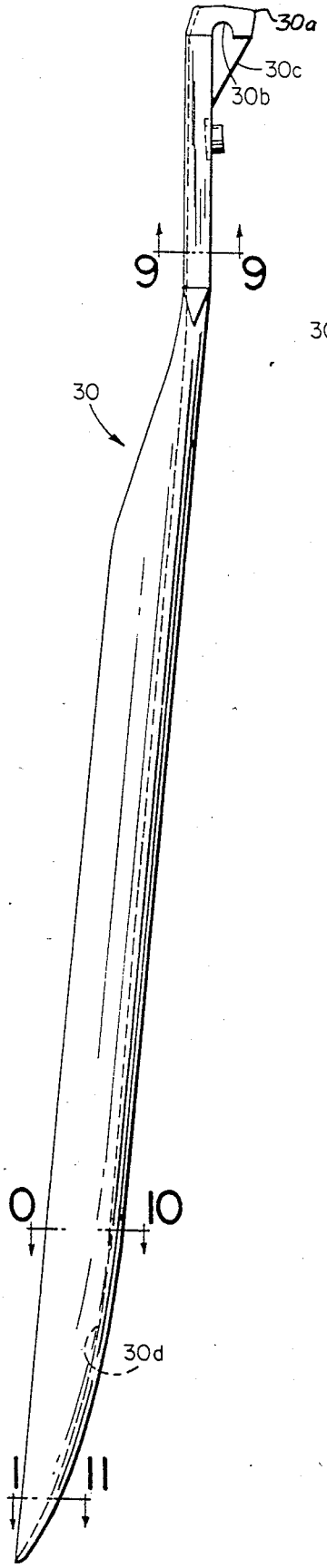
FIG. 12 is an elevational view of the finger shown partly in FIGS. 5, 8 and 9.
Figure 13:
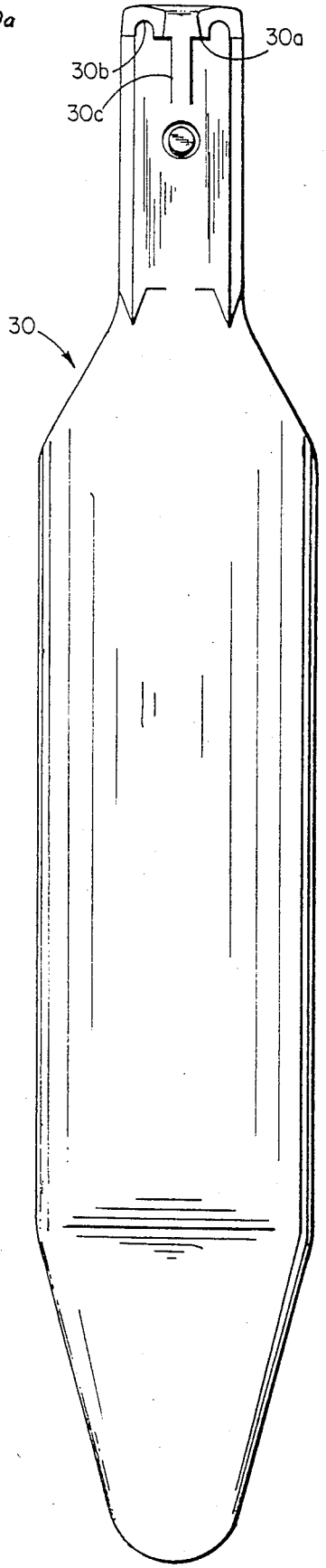
FIG. 13 is a rear elevational view of the finger shown in FIG. 12.
Figure 14:
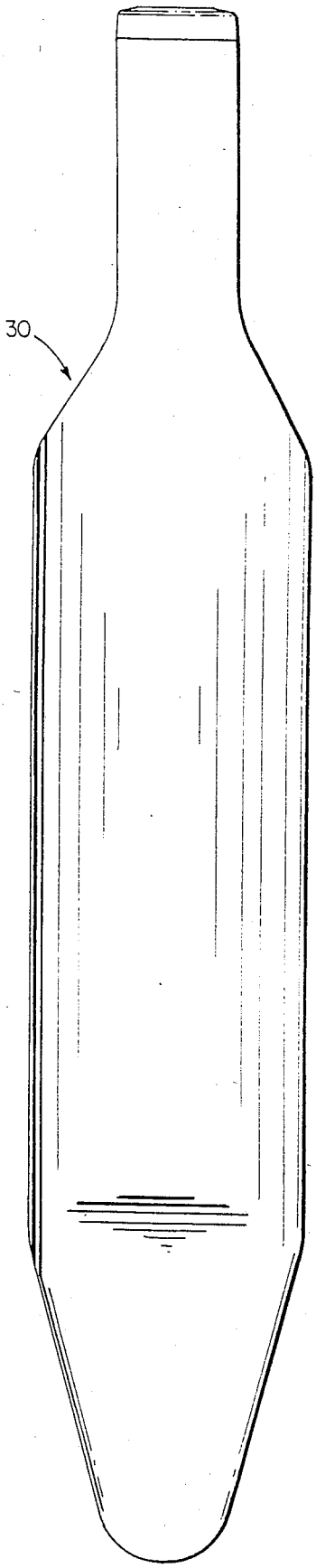
FIG. 14 is a front elevational view of the finger shown in FIGS. 12 and 13.

FIGS. 12, 13 and 14 show the overall configuration of a typical finger such as can be accommodated in the finger assembly which comprises the holder 18 and retaining member 26 as illustrated in FIG. 5. Each finger 30 comprises an elongated resilient member fabricated from a molded plastic material and uniquely shaped so as to have an upper end portion which defines a hook or inturned end adapted to be received in one of several circumaxially spaced sockets defined for this purpose between the retaining member 26 and the holder 18. More particularly, the hooked or inturned end 30*a* of the finger 30 has a downwardly facing concave configuration 30*b* which concave surface 30*b* is adapted to engage one of several upwardly facing convex surfaces 26*b*, 26*b* defined by the retaining member 26. As best shown in FIG. 5 this configuration permits limited pivotal motion of the finger 30 toward and away from the central axis of the fastener 22. Individual spring biasing means 28, 28 are provided to urge the fingers 30 outwardly toward the center of their associated pockets or passageways through which the descending articles A passes during the case loader's operating cycle.

Each finger 30 also includes a strengthening rib 30*c* integrally formed therein to strengthen the upper inturned end portion thereof. The retaining member 26 defines circumaxially spaced slots 26*c* for loosely receiving this rib 30*c* and it is an important feature of at least some versions of the present invention that the finger 30 is not only free to move toward and away from the central axis of the finger assembly as described above, but that this finger 30 is also capable of limited lateral movement perpendicular to the plane of normal finger motion defined by the longitudinal axis of the finger 30 and the axis of the finger assembly itself. The above mentioned pending application Ser. No. 273,012 describes and claims this feature of a typical finger assembly, and this freedom of movement is achieved by providing the finger retaining member 26 on the fastener 22 so that it is capable of limited vertical sliding movement relative to the fastener 22. The fingers are biased upwardly by a spring 24 provided for this purpose on the fastener 22. The fastener has a threaded lower end portion to receive a washer 23 and a nut 25 which controls the biasing force exerted by the spring 24 on the retaining member 26 so that the restoring force provided on the various fingers held in the finger assembly can be adjusted conveniently so as to preload the finger assembly. The preload is chosen to accommodate limited lateral motion of an individual finger as caused, for example by interference between the lower end of the finger and a case being loaded.

Figure 10:
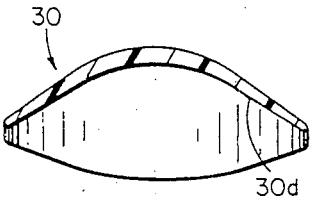
FIGS. 10 and 11 are sectional views through the finger illustrated in its entirety in FIG. 12.
Figure 11:
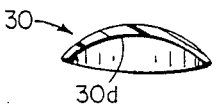
Figure 15:
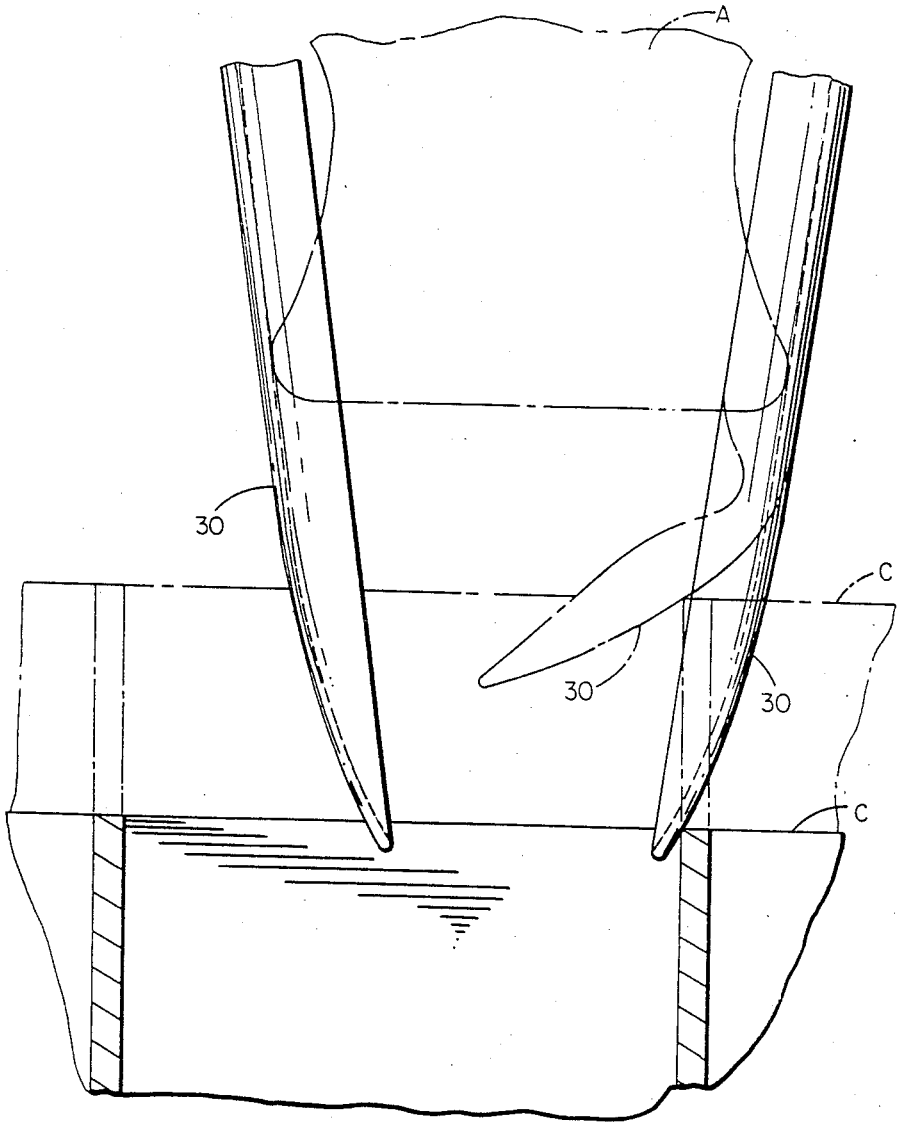
FIG. 15 is a schematic view to illustrate the result of interference between the lower end of a finger and a partition in the packing case with the finger being illustrated in solid lines in a normal position and in phantom lines to illustrate how the finger is effected by interference of the type sometimes encountered between one of the fingers and the packing case as the latter is elevated into mating relationship with the fingers.

It is an important feature of the present invention that the configuration for the lower end portion of the finger 30 defines a generally spoon shaped geometry as best shown in FIGS. 10, 11 and 12. More particularly, the front surface 30*d* of this lower spoon shaped portion of the finger 30 is adapted to be engaged by an article to guide the article as it is dropped downwardly into the desired area of the packing case. This surface 30*d* is concave both in vertical and horizontal cross section so as to not only guide the downwardly falling article, but to also provide a unique deformation hysterisis for the spoon shaped lower end portion of the finger when the finger is inadvertently deformed as suggested in FIG. 15. When, for example the finger strikes a partition within the case C, or bottle left in the case C, or an inadvertently closed case flap, or a crushed case side wall, during mating of the case with the grid assembly during the machine's cycle of operation interference can sometimes result. The unique geometry for this lower end portion of the finger is such that the spoon shaped geometry causes the finger to be deformed as suggested by the broken and phantom line positions upon contact with the case C. The finger 30 is in effect prevented from deformation in the opposite direction thereby preventing damage to the finger 30. Another advantage of this spoon shaped finger is the tendency for prior art fingers to lose their shape after long periods of use. This shape has been found to avoid such tendency for the finger to "forget" its original shape. Prior art plastic fingers, not provided with the spoon shaped geometry described above have been found to deform in this opposite direction. Although FIG. 15 shows the finger 30 striking a portion of the case C, and more particularly a partition wall therein, another common problem in case loaders generally can be attributed to the presence of a foreign object in a particular partition or cell of the case, with the result that a finger, or fingers, are bent by the object (usually a bottle) in much the same manner as that shown in FIG. 15. In some cases the bottle may be so located as to create a situation where the finger will acutally penetrate the open end of the bottle, creating forces on the finger that must be accommodated without destroying the finger. The spoon shaped configuration provides a unique shape that the finger will always assume by "memory" regardless of the sometimes severe situations that it is subject to.

As illustrated in FIG. 15 the lower spoon shaped end portion of the finger 30 is adapted to bend readily about a laterally extending axis defined just above the region of the spoon shaped lower end portion itself, and generally at the location for sectional view 10, 10 in FIG. 12. As a result of the resilient molded plastic material utilized for the finger 30, and as a result of the spoon shaped geometry for this lower end portion of the finger 30 the lower end portion deforms more readily in the desired direction (i.e. toward the center of the pocket or passageway) and not as easily in the opposite direction. In a typical case loading machine a large number of fingers are provided in a grid assembly such as that shown in FIG. 1, and longer finger life has been experienced as a result of providing fingers of the type shown in FIG. 15, as compared to the finger geometry illustrated in the prior patent application Ser. No. 273,012 and other prior art plastic finger configurations generally.

Another significant advantage for the finger assemblies illustrated in FIGS. 1–15, as compared to the prior art finger assemblies generally, can be attributed to the fact that each finger has its own individual finger return spring 28 arranged between the backside of each finger and the retaining member as best shown in FIG. 5. Providing individual finger return springs for each of these pivotably supported fingers in each circumaxially spaced cluster provides more predictable individual finger movement in spite of the finger movement of another finger in the cluster caused by the fact that each finger in each cluster is associated with its own individual pocket for receiving one of several independently free falling articles. It has been found advantageous to provide independent restoring forces for the individual fingers to accommodate engagement between each article and finger without the necessity for compromising the spring force on three of the four fingers in a cluster when one finger experiences some unusal deformation, such as suggested in FIG. 15 for example.

DETAILED DESCRIPTION OF FIGS. 16–24

Figure 16:
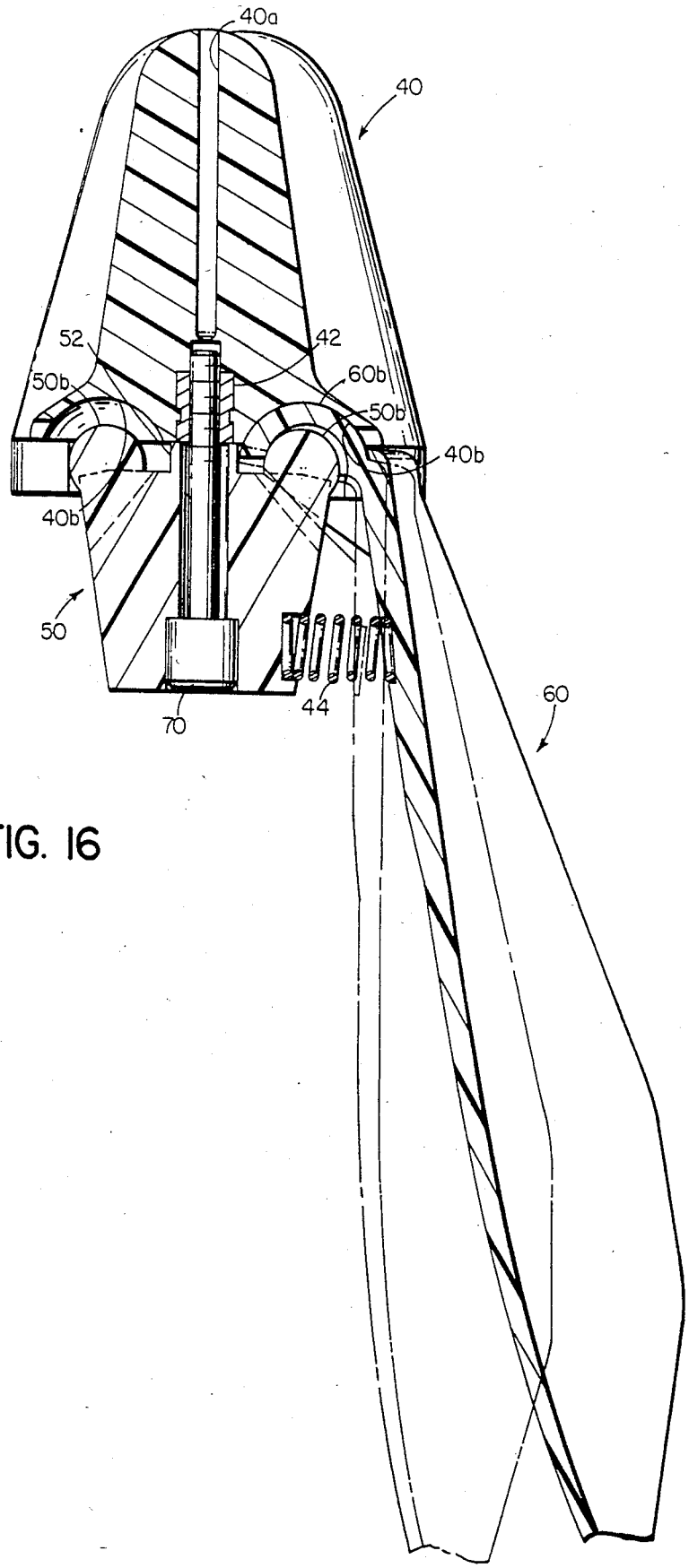
FIG. 16 is a vertical sectional view through an alternative construction for a finger assembly constructed in accordance with the present invention, only one of up to four fingers being shown.
Figure 19:
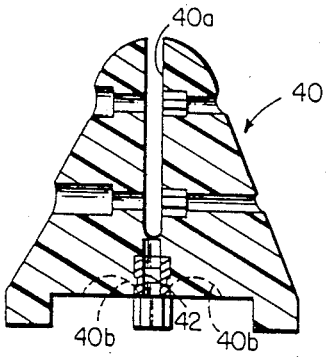
FIG. 19 is a sectional view taken generally on the line 19—19 of FIG. 20.
Figure 20:
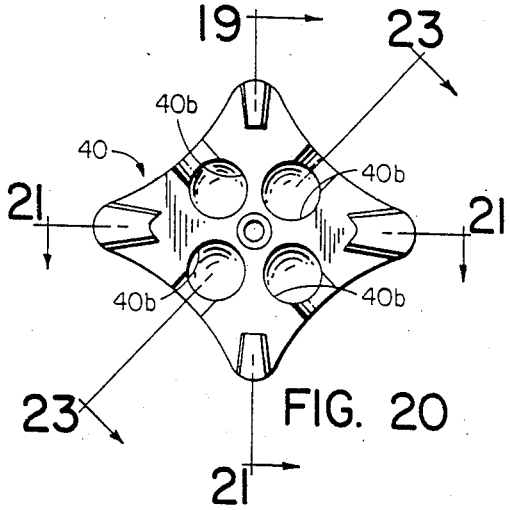
FIG. 20 is a view similar to FIG. 4 but illustrates the alternative configuration for the holder shown in FIG. 16.
Figure 21:
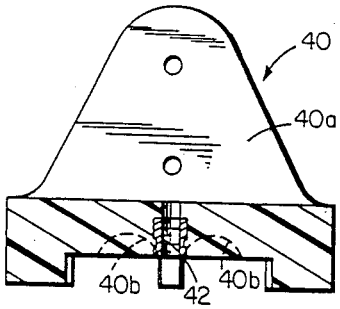
FIG. 21 is a sectional view taken generally on the line 21—21 of FIG. 20.
Figure 22:
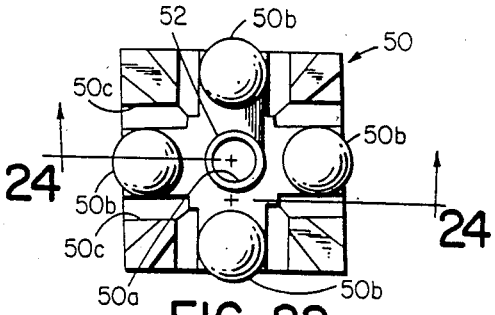
FIG. 22 is a plan view of the retainer shown in FIGS. 16 and 18, being similar to that of FIG. 6 and illustrating the retainer member configuration for the alternative finger assembly of FIG. 16.
Figure 23:
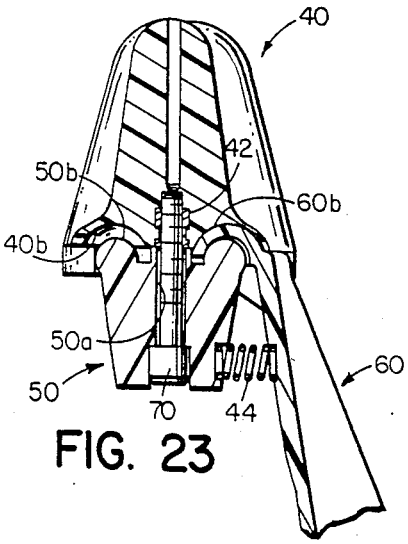
FIG. 23 is a sectional view taken generally on the line 23—23 of FIG. 20 and corresponds generally to FIG. 5 for the previous embodiment.

Turning now to the alternative embodiment for a finger assembly such as can be utilized in a packing case loading machine of the type outlined previously, FIG. 16 showns a finger assembly in accordance with an alternative embodiment of the invention. The finger assembly includes a holder 40 having an upwardly open slot 40*a* for receiving a rail, such as described previously with reference to FIGS. 1–5 inclusively, and the holder 40 of FIG. 16 can be similarly attached to such a rail by fasteners (not shown) as suggested in FIG. 19. The holder 40 is similar to the holder 18 described above except that the bottom surface thereof (best shown in FIG. 20) defines downwardly open concave parti-spherical cavities 40*b*, 40*b* spaced circumaxially around the vertical central axis of the holder 40 for a purpose to be described. A comparison between FIGS. 19, 20 and 21 (and the holder 40) with FIGS. 2, 3 and 4 (and the holder 18 of the previous embodiment) shows that these holders are otherwise similar, but as seen from the bottom in the views of FIGS. 20 and 4 the provision of four recessed sockets defined by the generally spherical cavities 40*b*, 40*b* of the holder and not primarily by the retaining member as is true of the sockets described previously with reference to FIGS. 1–15.

Figure 24:
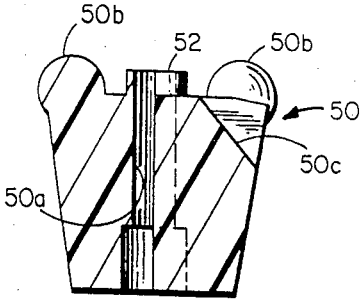
FIG. 24 is a sectional view taken generally on the line 24—24 of FIG. 22.

The retaining member 50 which mates with the holder 40 to define the sockets for pivotably receiving the upper end portions of the fingers 60 has an upper end portion, best shown in FIG. 24, defining four generally spherical protuberances 50*b*, 50*b* which cooperate with the concave spherical cavities 40*b* to define the sockets which receive the inner end portions 60*b*, of the plastic fingers 60.

As shown in FIG. 16 an elongated fastener 70 extends upwardly through a central opening or bore 50*a* in the retaining member 50 to be threadably received in a metal insert 42 provided for this purpose in the injection molded plastic finger holder 40. As shown in FIG. 16, the retaining member 50 and the holder 40 are anchored together without provision for relative motion therebetween as was true with reference to the previous embodiment (see FIG. 5). It will of course be apparent that such relative motion might be provided for, and that a spring could conceivably by provided between the head of fastener 70 and the retaining member 50 so as to provide for limited relative motion between these parts 50 and 40. However, in the embodiment shown in FIG. 16, these members 40 and 50 are anchored in secure relationship relative to one another by reason of an upstanding collar 52 integrally formed on the upper surface of the retaining member 50, which collar abuts the underside of the holder 40 to provide a predetermined clearance between the under surfaces of finger inner ends 60*b* and the spherical convex protuberance 50*b*, as well as between the top surfaces of the inner ends 60*b* of the fingers and the convex cavities 40*b* of the retaining member.

Figure 17:
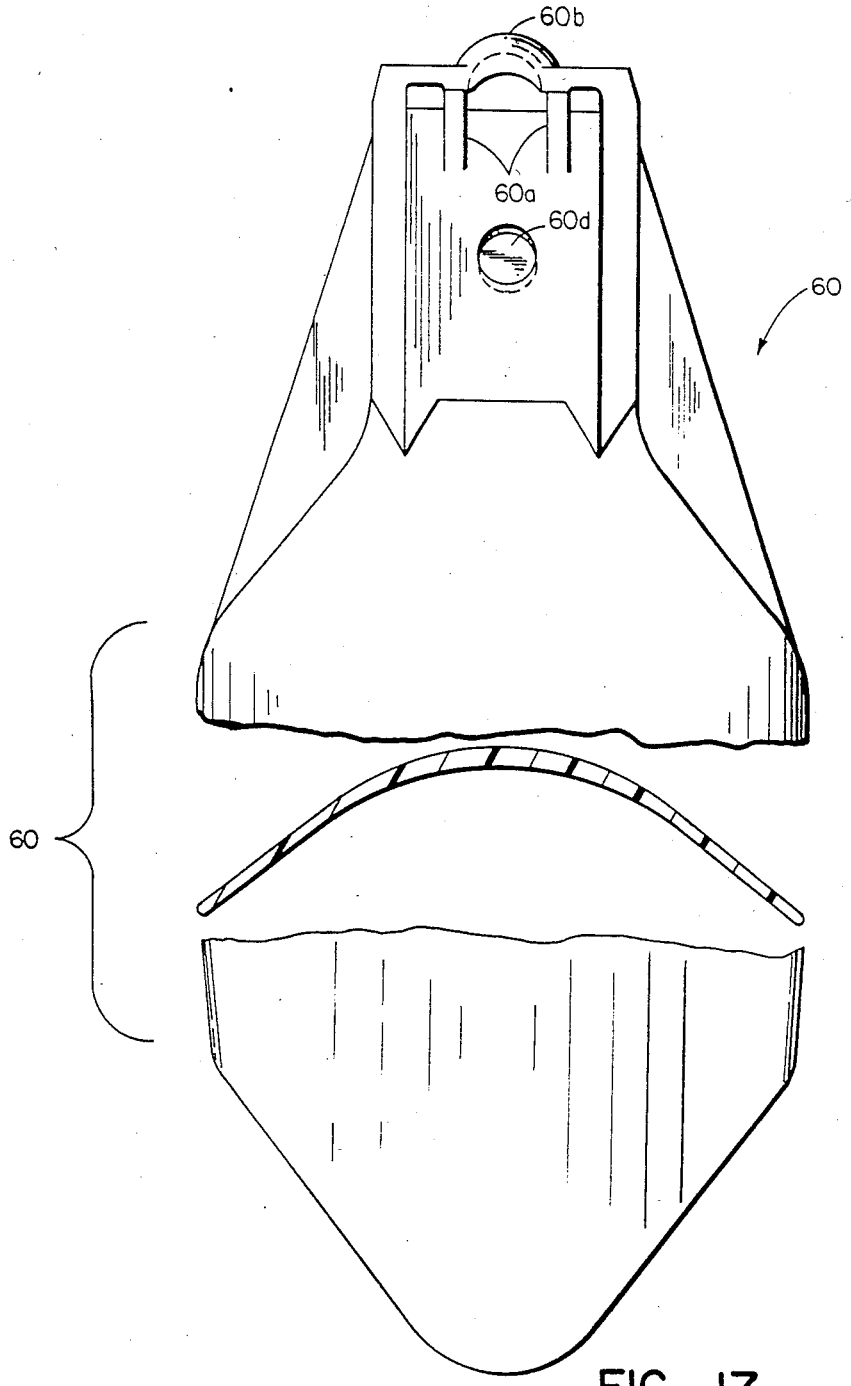
FIG. 17 is a view from the rear of a finger, such as that shown in FIG. 16 and FIG. 17, and also illustrates the cross sectional configuration for the finger at its midpoint.
Figure 18:
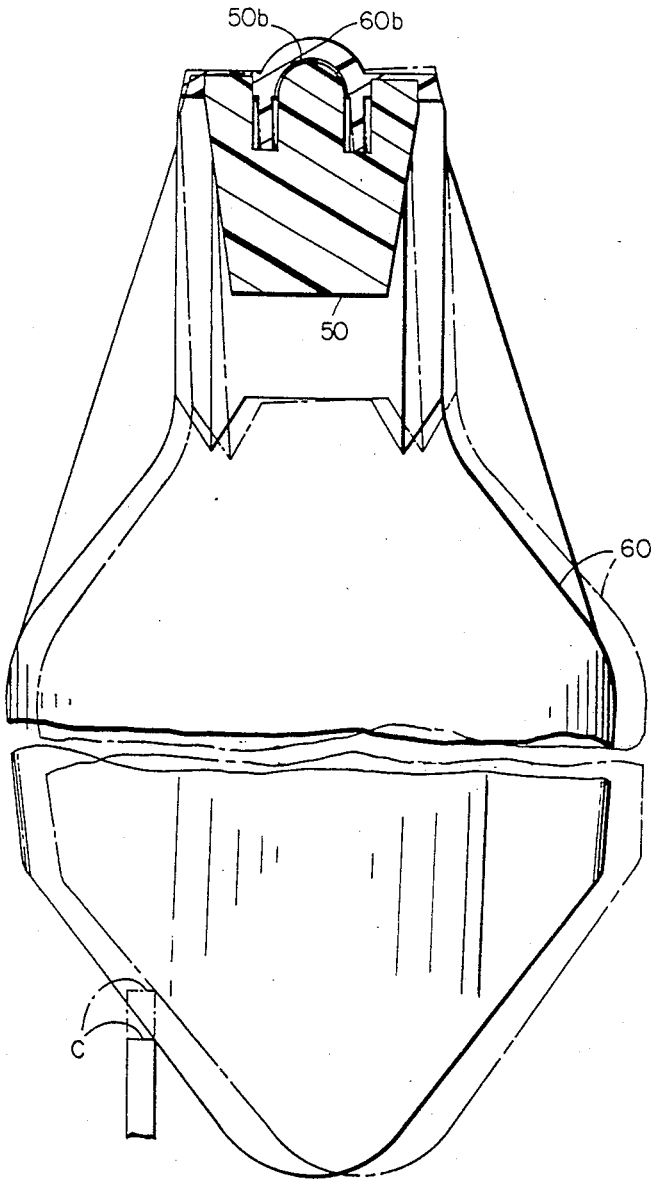
FIG. 18 is a view of the finger illustrated in FIG. 17 but shows the finger in a normal solid line position and in a phantom line position wherein the finger is deflected laterally relative to its retainer.

Finally, as a replacement for a central spring of the type associated with the shank of fastener, individual finger return springs 44, 44 are provided between the retaining member 50 and the inside of each finger 60 in order to provide a restoring force for the fingers such that each finger is urged outwardly away from the central axis of the finger assembly itself, toward a position where each finger will engage a downwardly falling article in order to guide that article into a particular cell defined by the partition in the packing case to be loaded. Each finger has a configuration such as that shown in FIG. 17 wherein the upper end portion 60*b* projects inwardly toward the central axis of the finger assembly, and which portion defines an arcuately curved three dimensional pivot area with a shape complementary to that defined by the parti-spherical socket portion of the holder and retaining members so that each finger is free to move between the limit positions illustrated for it in FIG. 16. Each finger further includes at least one reinforcing rib, and preferably two such ribs 60*a*, are formed integrally as shown. These ribs 60 fit loosely in a pair of slots 50*c*, 50*c* in each side of the generally four sided retaining member 50 as best shown in FIG. 18. Still with reference to the finger 60 of FIG. 17 a return spring locating lug 60*d* is preferably provided on the inside surface thereof, being spaced below the pivot point defined by the inner or hooked end 60*b*. The lower end portion of the finger 60 is spoon shaped as described previously with reference to the finger of FIGS. 12, 13 and 14 so as to have a concave configuration in both horizontal and vertical section, which shape provides the same advantages as discussed hereinabove with reference to the finger 30 in FIG. 15.

FIG. 18 illustrates the lateral movement of finger 60 which is provided for when a finger of the present invention comes into contact with a carton C during the cycle of the case loading machine so as to provide limited relative motion for the finger 60 when an interference condition exists rather than contributing to the breaking of the plastic finger itself as a result of such interference. As described above with reference to FIG. 15, the geometry of the spoon shaped lower end of the finger 60 (not shown) is substantially identical to finger 30, and therefor this feature of finger 60 need not be described in detail with reference to FIGS. 16–24.

Fingers 60, 60 are preferably made from a rigid molded material and the springs 44, 44 have a high spring compression rate 30 as to provide a retarding force on the falling articles. The degree of retarding force can be varied by simply changing the springs used in a particular application.

DETAILED DESCRIPTION OF FIGS. 25–27

Turning next to the second alternative embodiment for a finger assembly such as can be adapted for use in a packing case loading machine of the type described previously, FIG. 25 shows a holder 140 similar to the holder 40 described with reference to FIG. 16, that is holder 140 has an upwardly open slot 140*a* for receiving a rail (not shown) but as described previously with reference to FIGS. 1–5. Fasteners (not shown) are adapted to attach the holder 140 to such a rail as suggested previously with reference to FIG. 19. The holder 140 like the holder 40 is similar to holder 18 described above except that the bottom surface thereof defines downwardly open concave parti-spherical cavities 140*b*, 140*b* spaced circumaxially around the vertical central axis of the holder 140 as described previously with reference to the FIG. 16 embodiment.

Retaining member 150 mates with the holder 140 much like retainer 50 mates with holder 40 in the FIG. 16 embodiment. Sockets are defined between the retaining member 150 and the holder 140 for pivotably receiving the upper end portions of fingers 60 identical to the finger 60 described previously with reference to 16 through 24 inclusively. Generally spherical protuberances 150*b* cooperate with the concave spherical cavities 140*b* to define these sockets, and the inner end portions 60*b*, 60*b* of the plastic finger 60, 60 are pivotably received in these sockets as shown in FIG. 25.

Figure 25:
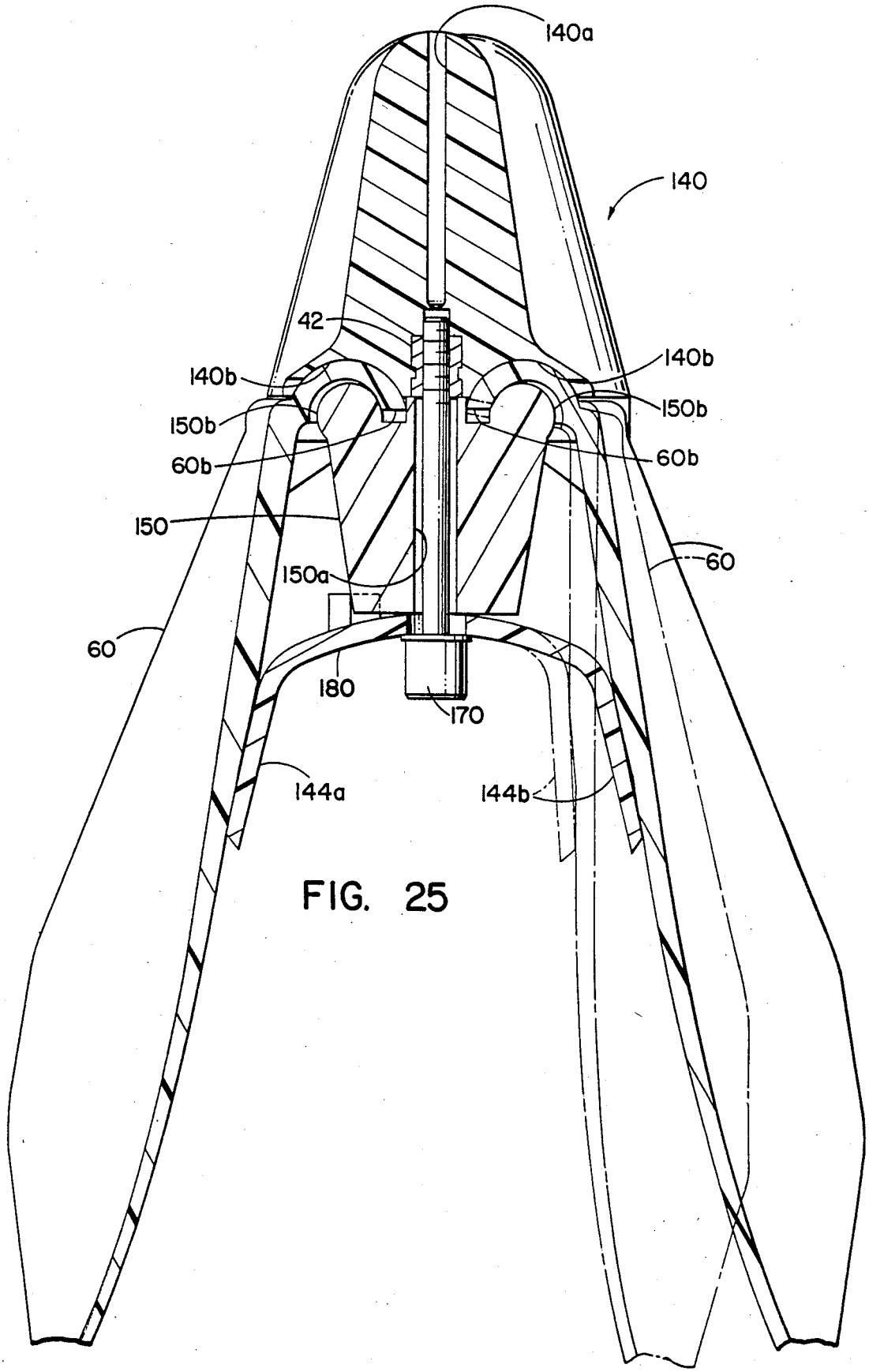
FIG. 25 is a vertical sectional view through a second alternative construction for a finger assembly, being generally similar to the view of the first alternative construction illustrated in FIG. 16. Two opposed fingers are shown out of a possible four fingers in a typical finger assembly, and one of these two fingers is shown in an alternative position.
Figure 26:
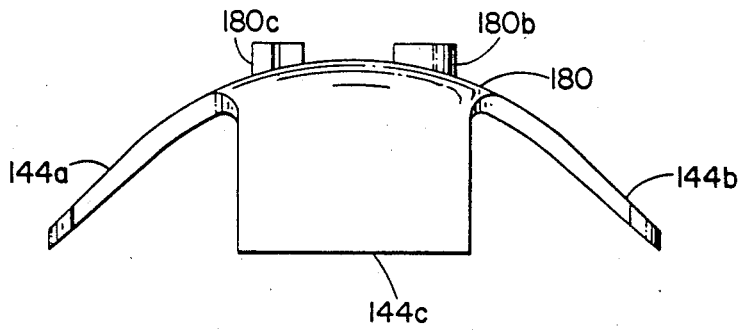
FIG. 26 is a side elevational view of the one piece molded part that defines the four individual spring petals associated with the four fingers in the FIG. 25 figure finger assembly.

Still with reference to FIG. 25 an elongated fastener 170 extends upwardly through a central opening or bore 150*a* of the retaining member 150 with the inner end of the fastener 170 threadably received in a metal insert 42 provided for this purpose in the injection molded plastic holder 140. The FIG. 25 assembly differs from that shown in FIG. 16 in that the head of fastener 170 also serves to retain a one-piece molded spring part 180 in a normal position such as that shown wherein all of the fingers 60, 60 are biased outwardly with respect to the central axis of the fastener 170 much like the fingers 60 described previously with reference to FIG. 16 are so biased by the individual coil springs 44, 44. FIG. 26 shows this part 180 as having a generally spherical shape. This shape provides for the desired degree of bending for a given restoring force on a finger. By selecting material of predetermined elastic modulus, such as an elastomeric thermoplastic urethane, one can provide the desired spring force for a particular finger assembly application.

Figure 27:
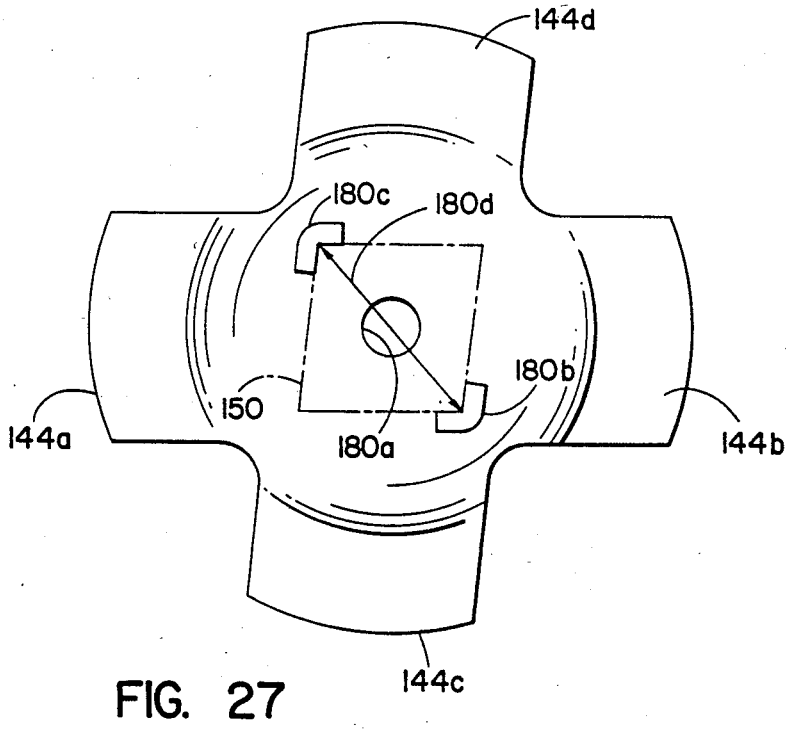
FIG. 27 is a top plan view of the molded spring part depicted in FIG. 26.

Such a one piece plastic spring part 180 is shown in some detail in FIGS. 26 and 27 wherein four leaf spring petals 144*a*, 144*b*, 144*c* and 144*d* are shown in spaced circumaxial relationship around a center opening 180*a* through which the fastener shank 170 is adapted to pass in anchoring the plastic spring part 180 in position as shown in FIG. 25.

As mentioned above the spring part 180 shown in FIG. 26 is depicted in its unstressed spherical configuration, and in FIG. 25 the fingers 60, 60 are held in their outer limit positions so as to deform the legs or petals 144*a*–144*d* and thereby exert a restoring force on the fingers 60, 60 which restoring force is proportional to the degree of deformation of these spring petals 144*a*–144*d* between these two positions. As a particular finger 60 (for example the right-hand finger in FIG. 25) is biased inwardly by a downwardly dropping article in an associated pocket or passageway, finger 60 will be moved from the solid line position shown toward the broken line position shown in FIG. 25 causing further deformation of plastic spring petal 144*b*. The restoring force exerted by this depending petal 144*b* of plastic spring part 180 causes finger 60 to be biased towards the solid line position shown much like the individual coil springs 44, 44 in the finger assembly described above with reference to FIGS. 16–24.

Still with reference to FIG. 26 upstanding lugs 180*b* and 180*c* are provided in the top surface of plastic spring part 180 so as to mate with openings in the lower end portion of retaining member 150 as suggested by the phantom lines for the retaining member location as best shown in FIG. 27. Since the plastic spring part 180 is provided with the four self-spring petal 144*a*, 144*d* at a non-symmetrical spacing with reference to the axis of the fastener upon which this part 180 is mounted, it is necessary to so locate the legs 180*b* and 180*c* that this part 180 can only be assembled in proper relationship to the various fingers 60, 60. The fingers are also supported in a non-symmetric relationship relative to the axis of the fastener 170 as described above. The diagonal dimension 180*d* in FIG. 27 for the rhombus shaped retainer 150 is such that it is shorter than the opposite diagonal for the rhombus shaped retaining member 150 and these legs preclude assembly of the plastic spring part 180 in anything but the proper orientation.

I claim:

1. A finger assembly for a case loader comprising a finger holder defining a vertical central axis, means mounting said holder on the loader, a finger retaining member, means for releasably clamping said retaining member to said holder, said holder and retaining member disposed axially one above the other and cooperating with one another to define abutment surfaces to locate said retaining member in axially clamped relationship to said holder, said holder and retaining member also cooperating to define a plurality of circumaxially spaced finger sockets therebetween, each socket having a generally spherical bearing surface, a plurality of downwardly projecting circumaxially spaced fingers, each of which fingers includes an upper end of generally complementary spherical shape adapted to bear upon said spherical socket surface, said finger being movable pivotably in said socket toward and away from the axis of said holder and retaining member, said socket being so shaped spherically that said finger is also movable from side-to-side relative to such movement toward and away from said axis, and finger biasing means acting on said fingers to urge said fingers away from said axis.

2. The finger assembly of claim 1 wherein each said spherical socket defined surface has a lower portion defined by said retaining member and an upper portion defined by said holder, said complementary spherically shaped finger upper end having upper and lower surface portions which match the concave contour of said upper and lower socket surface portions respectively.

3. The finger assembly of claim 1 wherein each finger has a lower end portion of generally spoon shape such that the front surface which is engaged by an article dropped downwardly into a case in the loader is concave both in vertical cross section and in horizontal cross section, said finger having a portion intermediate said upper end and said lower spoon shaped end having a concave front surface to guide the descending article.

4. The finger assembly of claim 3 wherein each finger further has a rear surface of convex contour and wherein each finger has a modulus of elasticity and a thickness such that the spoon shaped lower end will strain in bending along a chord line located adjacent to the juncture between said intermediate portion and said spoon shaped lower end, said bending being readily accommodated by said finger configuration when the lower end is stressed by a force acting away from said holder axis and said bending being inhibited by said finger configuration when the lower end is stressed by a force acting toward said holder axis

5. The finger assembly of claim 2 wherein said finger biasing means comprise individual compression springs for each finger, each spring acting between the rear surface of the finger and one of a plurality of spring seating surfaces defined by said retaining member.

6. The finger assembly of claim 5 wherein said finger biasing means further comprises at least one compression spring acting on said retaining member and coupled to said retaining member clamping means to urge said retaining member toward said holder.

7. A finger assembly for a case loader comprising a finger holder, means mounting said holder on the loader, a finger retaining member, an elongated fastener means for releasably clamping said retaining member to said holder, said holder and retaining member disposed axially one above the other and cooperating with one another to define circumaxially spaced finger sockets therebetween, a plurality of fingers having radially inturned upper ends for pivotably supporting said fingers in said finger sockets so that depending portions of the fingers are free to move toward and away from said elongated fastener and the axis thereof, individual coil springs acting in compression to urge each finger away from said axis, each spring having an outer end engaging one of said fingers at a point spaced below said inturned upper end and said spring having an inner end engaging said retaining member, said retaining member having convex socket portions cooperating with inturned upper finger ends of complementary concave cross section to provide said pivotably supported fingers in normal positions wherein they cooperate with the fingers of other such finger assemblies to form pockets through which articles drop to load a case.

8. The finger assembly of claim 7 wherein each finger is elongated and has a lower end of generally spoon shape such that the front surface which is engaged by an article dropped downwardly into a case in the loader is concave both in vertical cross section and in horizontal cross section, said finger having an elongated portion intermediate said upper end and said lower shaped end, said elongated portion having a concave front surface to guide the descending article.

9. The finger assembly of claim 8 wherein each finger further has a rear surface of convex contour and wherein each finger has a modulus of elasticity and a thickness such that the spoon shaped lower end will strain in bending along a chord line located adjacent to the juncture between said intermediate elongated portion and said spoon shaped lower end, said bending being readily accommodated by said finger configuration when the lower end is stressed by a force acting away from said holder axis and said bending being inhibited by said finger configuration when the lower end is stressed by a force acting toward said holder axis.

10. A finger assembly for a case loader comprising a finger holder mounted to the loader, a finger retaining member cooperating with said holder to define a plurality of finger sockets therebetween, an axially elongated central fastener extending centrally through an opening in said retaining member and secured to said holder, a plurality of fingers having inturned upper ends for pendulously supporting said fingers in said sockets for movement inwardly toward and outwardly away from the central axis of said fastener, each finger having a portion of said inturned upper end with a downwardly facing concave contour slidably engaging a convex portion of said retaining member to pendulously support each finger for movement inwardly toward and outwardly away from said central fastener, and means biasing said fingers outwardly to cooperate with the fingers of other such finger assemblies to form pockets through which articles drop to load a case, and each finger fabricated from a resiliently deformable material, each finger having an elongated portion intermediate its upper and lower ends, and said lower end being of generally spoon shape such that the front surface thereof is adapted to be engaged by an article dropped downwardly into a case, said spoon shaped front surface being concave in both vertical and horizontal cross section, said elongated portion having a lateral or horizontal cross section that is concave to guide the articles so dropped.

11. A finger assembly for a case loader comprising a finger holder, means mounting said holder on the loader, a finger retaining member, means for releasably clamping said retaining member to said holder, said holder and retaining member disposed axially one above the other and cooperating with one another to define abutment surfaces to locate said retaining member in axially clamped relationship to said holder, said holder and retaining member also cooperating to define a plurality of circumaxially spaced finger sockets therebetween, each socket having a generally spherical bearing surface, a plurality of downwardly projecting circumaxially spaced fingers, each of which fingers includes an upper end of a generally complimentary spherical shape adapted to bear upon said spherical socket surface, each of said fingers being movable pivotably in said socket toward and away from the axis of said holder and retaining member, said socket being so shaped that said fingers are also movable from side to side relative to such movement toward and away from said axis, finger biasing means acting on said fingers to urge said fingers away from said fastener axis, said finger biasing means including a one-piece plastic part retained on the underside of said retaining member by said clamping means which clamps said holder and retaining member, and said one-piece plastic part including integrally formed generally radially projecting petal portions engageable with the fingers respectively and being resiliently deformable individually to urge the fingers outwardly away from the axis of the retainer holder assembly.

12. The finger assembly of claim 11 wherein the resiliently deformable petal portions of said plastic part engage intermediate portions of said fingers slightly below the lower surface of said retaining member, and wherein said retaining member has a lower surface adapted to receive the upper surface of said plastic part.

13. The finger assembly of claim 12 wherein said fingers are elongated with lower ends of generally spoon shape such that the front surface which is adapted to being engaged by an article dropped downwardly into a case in the loader is concave both in vertical cross section and in horizontal cross section, said elongated portion intermediate said upper end and said lower spoon shaped end having a concave front surface to guide the descending article.

14. The finger assembly of claim 13 wherein each finger further has a rear surface of convex contour and wherein each finger has a modulus of elasticity in a thickness such that the spoon shaped lower end will strain and bend along a chord line located adjacent to the juncture between said intermediate elongated portion and said spoon shaped lower end, said bending being readily accommodated by said finger configuration when the lower end is stressed by a force acting away from said holder axis in said bending being inhibited by said finger configuration when the lower end is stressed by a force acting toward said holder axis.

15. A finger assembly for a case loader comprising a finger holder, means mounting said holder on the loader, a finger retaining member, elongated fastener means for releasably clamping said retaining member to said holder, said holder and retaining member disposed axially one above the other in cooperating with one another to define circumaxially spaced finger sockets therebetween, a plurality of fingers having radially inturned upper ends for pivotally supporting said fingers in said finger sockets so that depending portions of the fingers are free to move toward and away from said elongated fastener and the axis thereof, a one piece molded spring defining part with a central opening for receiving said elongated fastener so that said fastener secures said molded part to the lower surface of said retaining member, said molded spring defining part having integrally formed radially outwardly projecting petal portions acting like leaf springs to engage the backside of each finger and to be deformed downwardly by said fingers so as to act on the fingers and to urge them individually away from said axis, each downwardly deformed spring petal having an outer end portion engaging one of said fingers at a point spaced below said inturned upper end of said finger, and said retaining member having convex socket portions cooperating with inturned upper finger ends of complementary concave cross section to provide said pivotally supported fingers in normal positions wherein they cooperate with the fingers of other such finger assemblies to form pockets through which articles drop to load a case.

16. The finger assembly of claim 15 wherein each finger is elongated and has a lower end of generally spoon shape such that the front surface which is engaged by an article dropped downwardly into a case in the loader is concave both in vertical cross section and in horizontal cross section, said elongated portion intermediate said upper end and said lower spoon shaped end having a concave front surface to guide the descending article.

17. The finger assembly of claim 15 where each finger further has a rear surface of convex contour wherein each finger has a modulus of elasticity and a thickness such that the spoon shaped lower end will strain in bending along a chord line located adjacent to the juncture between said intermediate elongated portion and said spoon shaped lower end, said bending being readily accommodated by said finger configuration when the lower end is stressed by a force acting away from said holder axis and said bending being inhibited by said finger configuration when the lower end is stressed by a force acting toward said holder axis.

18. The finger assembly of claim 15 wherein said one piece molded deformable resilient spring defining part has an upper surface defining locating means to locate said plastic part relative to the retaining member in order that the radially outwardly projecting resiliently deformable petal portions are properly aligned with the finger locations in the resulting cluster of fingers provided in a finger assembly.

19. The finger assembly of claim 15 wherein said molded spring defining part has a generally spherical shape in its undeformed condition and wherein said part is fabricated from a thermoplastic material that is chosen to provide a desired modulus of elasticity to yield the desired degree of spring force for a predetermined degree of bending.

20. The finger assembly of claim 15 wherein each finger socket has a generally spherical bearing surface, each finger upper end having a generally complementary spherical shape such that the finger is free to move side-to-side as well as toward and away from said fastener axis.

* * * * *